US008904714B2

(12) United States Patent
Montalto et al.

(10) Patent No.: US 8,904,714 B2
(45) Date of Patent: Dec. 9, 2014

(54) MODULAR PEDESTRIAN TUNNEL

(75) Inventors: Carmelo Montalto, Turin (IT); Daniele Montalto, Turin (IT)

(73) Assignee: Big Astor S.R.L., Turin (IT)

( * ) Notice: Subject to any disclaimer, the term of this patent is extended or adjusted under 35 U.S.C. 154(b) by 0 days.

(21) Appl. No.: 13/080,969

(22) Filed: Apr. 6, 2011

(65) Prior Publication Data

US 2012/0255256 A1 Oct. 11, 2012

(51) Int. Cl.

| | |
|---|---|
| ***E04B 1/346*** | (2006.01) |
| ***E04H 1/00*** | (2006.01) |
| ***E04H 12/00*** | (2006.01) |
| ***A47B 3/00*** | (2006.01) |
| ***A47B 47/00*** | (2006.01) |
| ***E04G 1/15*** | (2006.01) |
| ***E04G 21/32*** | (2006.01) |

(52) U.S. Cl.

CPC ..... *E04G 21/3209* (2013.01); *Y10S 52/12* (2013.01)

USPC ..... 52/64; 52/79.5; 52/650.3; 52/DIG. 12; 108/35; 108/131; 108/185; 182/222

(58) Field of Classification Search

CPC ..... A47B 87/002; A47B 87/007; E04H 3/24; E04H 3/28; E04H 1/1211; E04G 11/48; E04G 21/32; E04G 21/3209; E04F 15/02458

USPC ..... 108/115, 125, 129, 131–132, 69, 90, 108/35, 59, 180, 185, 186, 155, 158.12; 248/188.1; 403/49; 52/64, 79.1, 79.5, 52/79.9, 220.1, 220.2, 650.3, 782.2, 52/796.11, 796.12, DIG. 12; 182/186.6, 182/222, 130, 223; 14/2.4

See application file for complete search history.

(56) References Cited

U.S. PATENT DOCUMENTS

| | | | | |
|---|---|---|---|---|
| 2,378,852 | A * | 6/1945 | James | 403/80 |
| 2,981,365 | A * | 4/1961 | Olsen | 182/223 |
| 3,033,630 | A * | 5/1962 | Mugler | 108/129 |
| 3,604,372 | A * | 9/1971 | Hewett et al. | 108/160 |
| 3,964,402 | A * | 6/1976 | Jenne' et al. | 108/64 |
| 4,144,822 | A * | 3/1979 | Roberts et al. | 108/129 |
| 4,222,459 | A | 9/1980 | Hard et al. | |
| 4,759,162 | A * | 7/1988 | Wyse | 52/126.6 |
| 4,915,034 | A * | 4/1990 | Grabe et al. | 108/65 |
| 4,942,708 | A * | 7/1990 | Krumholz et al. | 52/263 |

(Continued)

FOREIGN PATENT DOCUMENTS

| | | |
|---|---|---|
| CN | 2789335 | 6/2006 |
| CN | 201128949 | 10/2008 |

(Continued)

OTHER PUBLICATIONS

Chinese Office Action, with English translation, CN application No. 201210008353.7, Jan. 14, 2014, 16 pages.

(Continued)

*Primary Examiner* — Ryan Kwiecinski

(74) *Attorney, Agent, or Firm* — Fish & Richardson P.C.

(57) ABSTRACT

A tunnel structure includes a frame; a continuous plate fixed to the frame in order to protect passing-through pedestrians; supporting legs hinged to the frame; and a connecting section supported by the frame, the connecting section configured to enable the combination of multiple tunnel structures.

11 Claims, 9 Drawing Sheets

(56) References Cited

U.S. PATENT DOCUMENTS

| | | | | |
|---|---|---|---|---|
| 4,972,924 | A * | 11/1990 | Nielsen | 182/152 |
| 5,144,888 | A * | 9/1992 | Heine et al. | 108/64 |
| 5,205,087 | A * | 4/1993 | Jines | 52/6 |
| 5,319,906 | A * | 6/1994 | Hayden | 52/127.6 |
| 5,769,560 | A * | 6/1998 | Quam | 403/325 |
| 5,819,671 | A * | 10/1998 | Ocampo | 108/64 |
| 6,032,590 | A * | 3/2000 | Chen | 108/158.12 |
| 6,382,109 | B1 * | 5/2002 | Novikoff | 108/65 |
| 6,401,631 | B1 * | 6/2002 | Kane et al. | 108/116 |
| 6,920,834 | B1 * | 7/2005 | Pehta et al. | 108/147.21 |
| 6,976,438 | B2 * | 12/2005 | Lou-Hao | 108/129 |
| 7,107,913 | B2 * | 9/2006 | Smith | 108/64 |
| 7,249,563 | B2 | 7/2007 | Chen | |
| 7,581,709 | B2 * | 9/2009 | Gillespie et al. | 249/19 |
| 7,628,000 | B2 * | 12/2009 | Kahl | 52/588.1 |
| 7,703,401 | B2 | 4/2010 | Davis et al. | |
| 7,874,115 | B2 * | 1/2011 | Thiede | 52/506.01 |
| 7,950,336 | B2 * | 5/2011 | Phillips | 108/64 |
| 8,215,063 | B1 * | 7/2012 | Francis | 52/6 |
| 2004/0178306 | A1 * | 9/2004 | Hallberg | 248/188.5 |
| 2006/0191448 | A1 * | 8/2006 | Chen et al. | 108/125 |
| 2007/0138366 | A1 * | 6/2007 | Davis et al. | 248/434 |
| 2007/0175703 | A1 * | 8/2007 | Brasil | 182/222 |
| 2010/0024690 | A1 * | 2/2010 | Phillips | 108/64 |
| 2010/0175594 | A1 * | 7/2010 | Leng | 108/50.11 |
| 2012/0031017 | A1 * | 2/2012 | Stroyer | 52/157 |

FOREIGN PATENT DOCUMENTS

| | | |
|---|---|---|
| DE | 2054840 | 5/1972 |
| DE | 8100831 | 6/1981 |
| JP | 3-113003 | 11/1991 |
| JP | 2000-303682 | 10/2000 |
| JP | 2001-003578 | 1/2001 |
| JP | 2005-179951 | 7/2005 |
| JP | 2009-203688 | 9/2009 |

OTHER PUBLICATIONS

Notification of Reason(s) for Refusal, with English Translation, Japanese Application No. 2012-087346, mailed Jul. 9, 2013, 5 pages.

Japanese Office Action, with English translation, JP Application No. 2012-087346, mailed Aug. 12, 2014, 5 pgs.

* cited by examiner

MODULAR PEDESTRIAN TUNNEL

RELATED APPLICATIONS

Under 35 USC 119, this application claims the benefit of the priority date of European Patent Application 10172467.2, filed Aug. 11, 2010, the contents of which are herein incorporated by reference.

FIELD OF THE INVENTION

The present invention concerns the idea of a Modular Pedestrian Tunnel.

BACKGROUND

At construction sites, scaffolding or other structures are often erected to protect pedestrians and construction workers from the dangers posed by falling building material and tools.

SUMMARY

In a general aspect, a tunnel structure includes a frame; a continuous plate fixed to the frame in order to protect passing-through pedestrians; supporting legs hinged to the frame; and a connecting section supported by the frame, the connecting section configured to enable the combination of tunnel structures.

Embodiments may include one or more of the following.

The tunnel structure further includes an adjustment device configured to adjust the position of each of the supporting legs along an axis where the supporting legs are hinged to the frame.

The tunnel structure further includes a releasable grooved coupling device configured to connect each supporting leg to the frame in order to define an angular position of the supporting legs.

The tunnel structure further includes a spring configured to keep each supporting leg combined throughout the releasable grooved coupling device.

The tunnel structure further includes a releaseble grooved coupling having a length which allows two of the supporting legs to be revolving in their respective parallel axes which can be blocked in the hidden position one next to the other one.

The connecting element has a crossing L-shaped profile.

The connecting element includes almost one releaseble blocking element that allows to keep the supporting legs in an opening or closing position alternatively.

A length of each of the supporting legs is changeable.

Each of the supporting legs is hinged independently to the frame such that each supporting leg has its own angular position.

The connecting section is continuous. The connecting section is configured such that a gap between the connecting section and a connecting section of an adjacent tunnel structure is closed.

The connecting element is configured to enable the tunnel structure to withstand a stress resulting from the continuous plate.

At least one of the supporting legs is raised when the tunnel structure is positioned next to an adjacent tunnel structure. The at least one raised supporting leg is the supporting leg next to the connecting section next to the adjacent tunnel structure.

The modular pedestrian tunnel described herein can be used, for example, in order to cover pedestrian crossings in a building site, during renovation works or in case of restoration of a facade, in order to protect passing through pedestrians.

It is preferable to protect pedestrians that are passing through a surrounding area or beneath a building site, in case of renovation works, in a urban area or some works carried in elevation thanks to a crane or some lifting platforms.

The Modular Tunnel described herein is able to protect pedestrians from falling objects. It can be adaptable to different paths and it is also able to improve a walking person's safety.

Other features and advantages of the invention are apparent from the following description and from the claims.

BRIEF DESCRIPTION OF DRAWINGS

FIGS. 9 and 10 are perspective views according to the different slants of the same component;

DETAILED DESCRIPTION

Figure 1:
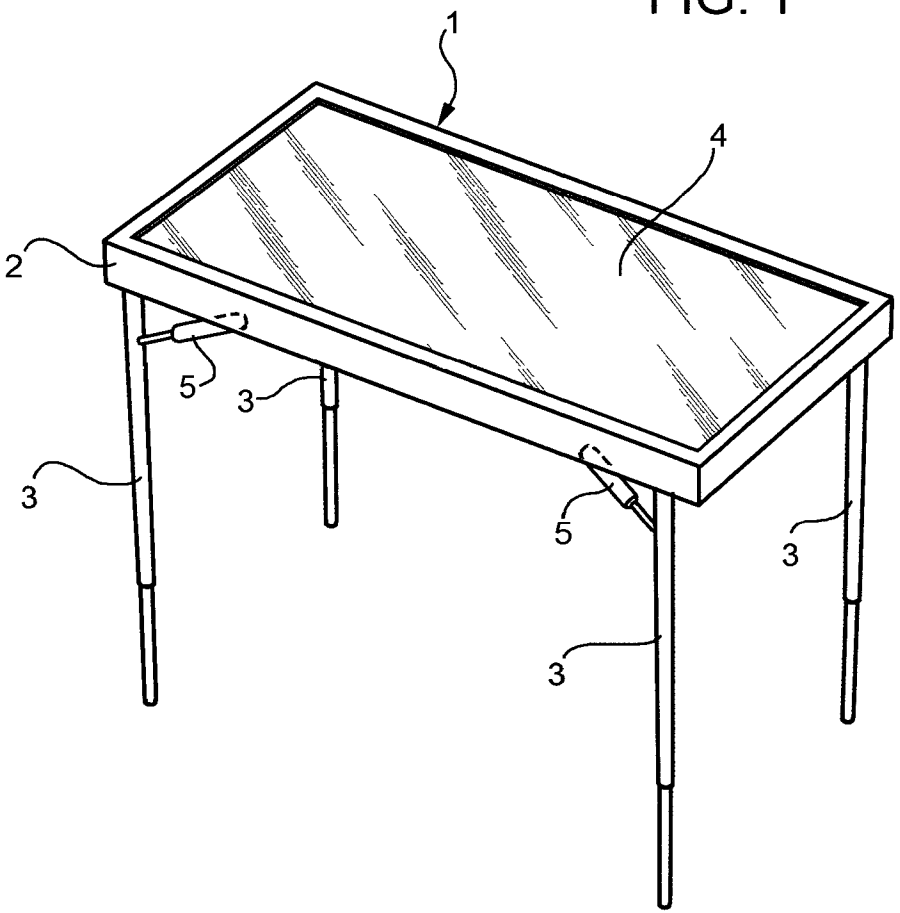
FIG. 1 shows a perspective view of a Modular Pedestrian Tunnel.
Figure 2:
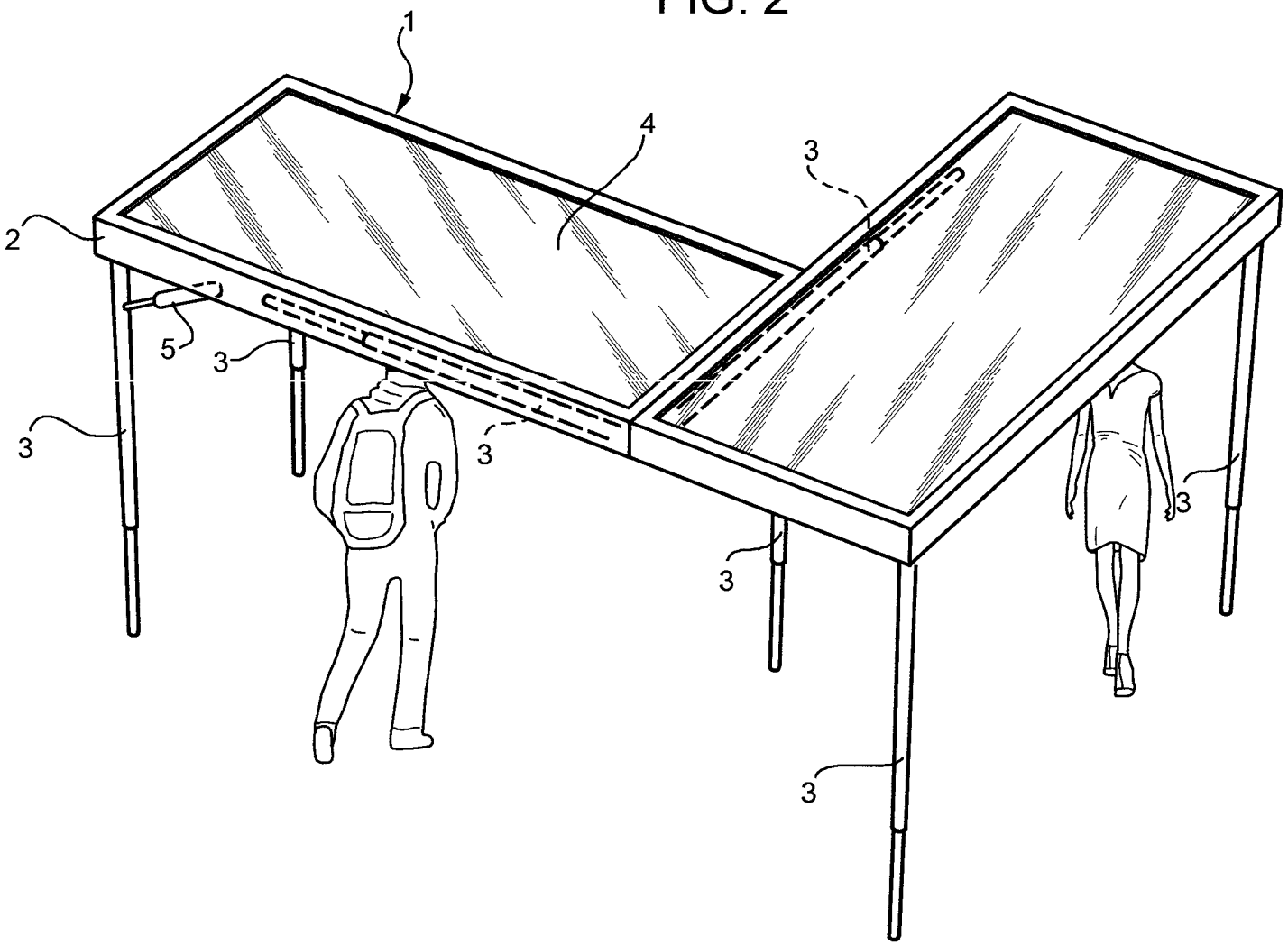
FIG. 2 shows a perspective view of a non-limiting configuration of two Tunnels' assembly.

FIGS. 1 and 2 show respectively a Tunnel module (1) and a couple of Tunnels (1) which are combined in order to protect a pedestrian crossing from falling objects, fragments, rainwater etc, for example, in case of works carried out at an elevated height from the road surface.

Each module (1) is composed by a polygonal frame (2), (e.g., a rectangular frame), at least 4 supporting legs (3) which are linked to the frame (2) and a roofing (4) fixed to the frame (2).

The supporting legs (3) are reflexible and, in a closed position, have a dimension that allows them to be placed, rollway, in the frame (2).

In other words, the reachable cross dimension of the supporting legs (3), as to say the largest diameter that tubular legs can reach, is smaller than the thickness of the frame (2).

Furthermore, the supporting legs (3) are combined to a releasable blocking element in order to keep every leg (3) in the same extracted position or in a closed position even against the action of the G-force when the Tunnel (1) is moved. For instance, in some embodiments the releasable blocking element is a small gas-filled cylinder (5) that connects the leg (3) and the frame (2). In this way, it is really simple to move, in a safe way, the above mentioned Modular Pedestrian Tunnel even for one user.

Figure 5:
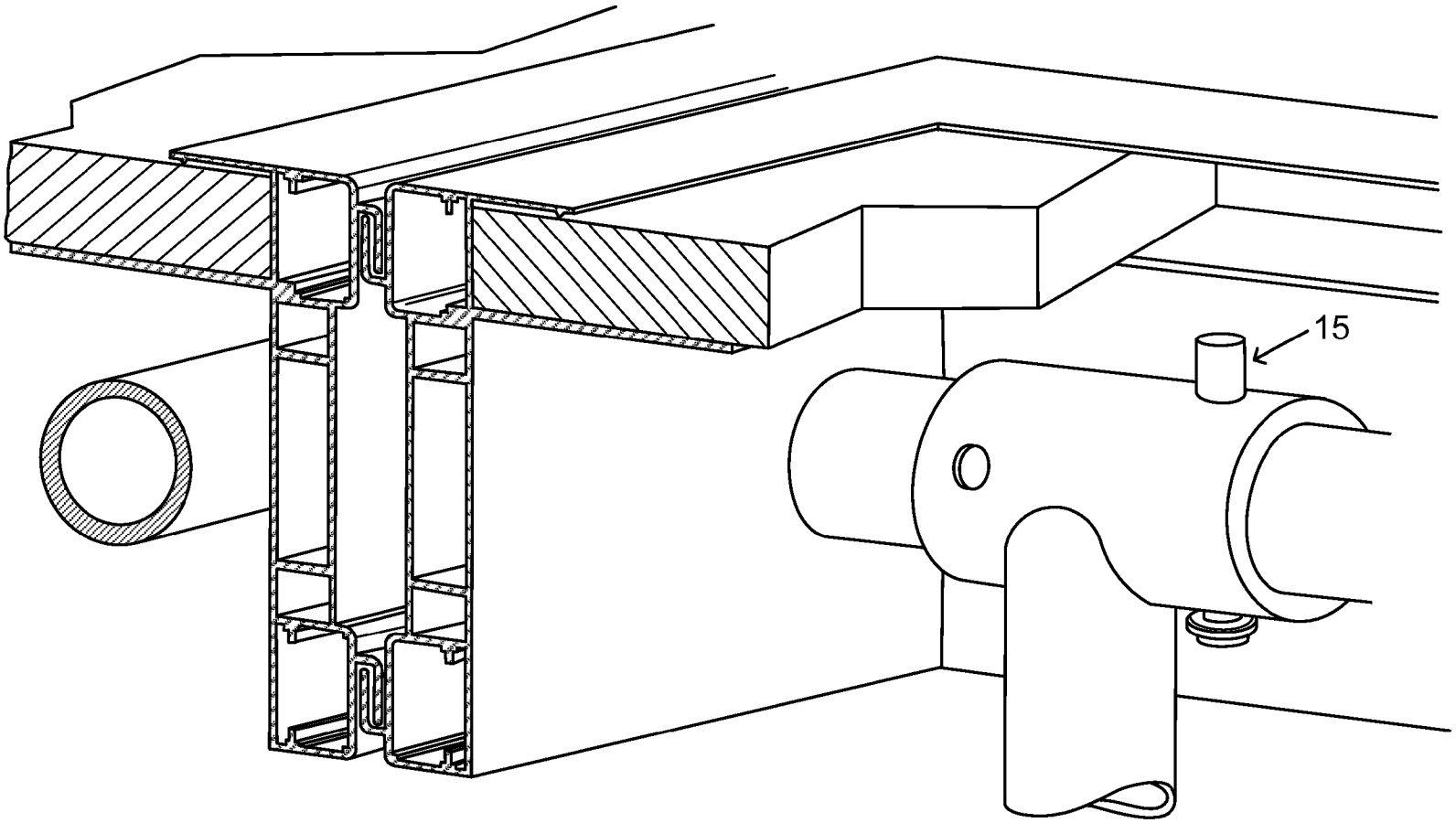
FIG. 5 shows a lower view of a detail in FIG. 2.

The tunnel module (1) (see FIG. 5) also includes a safety device which can be added to the gas-cylinder (5) in order to block supporting legs in an opened or closed position. In particular, the safety device includes a removable pin (15).

In order to allow the highest freedom of use, when two or more elements are linked together (1), every supporting legs (3) is reflexible in an independent way from the other legs (3). In this way, passing through pedestrians will be able to walk freely in a wide area without altering the stability of the tunnel (1).

Supporting legs (3) show an adjustable length and are also telescopic. The fact that supporting legs (3) are reflexible in an independent way allow the tunnel module to be placed in a loose ground, or on architectural elements like street furniture, plant pots, steps or stairways, etc.

Figure 3:
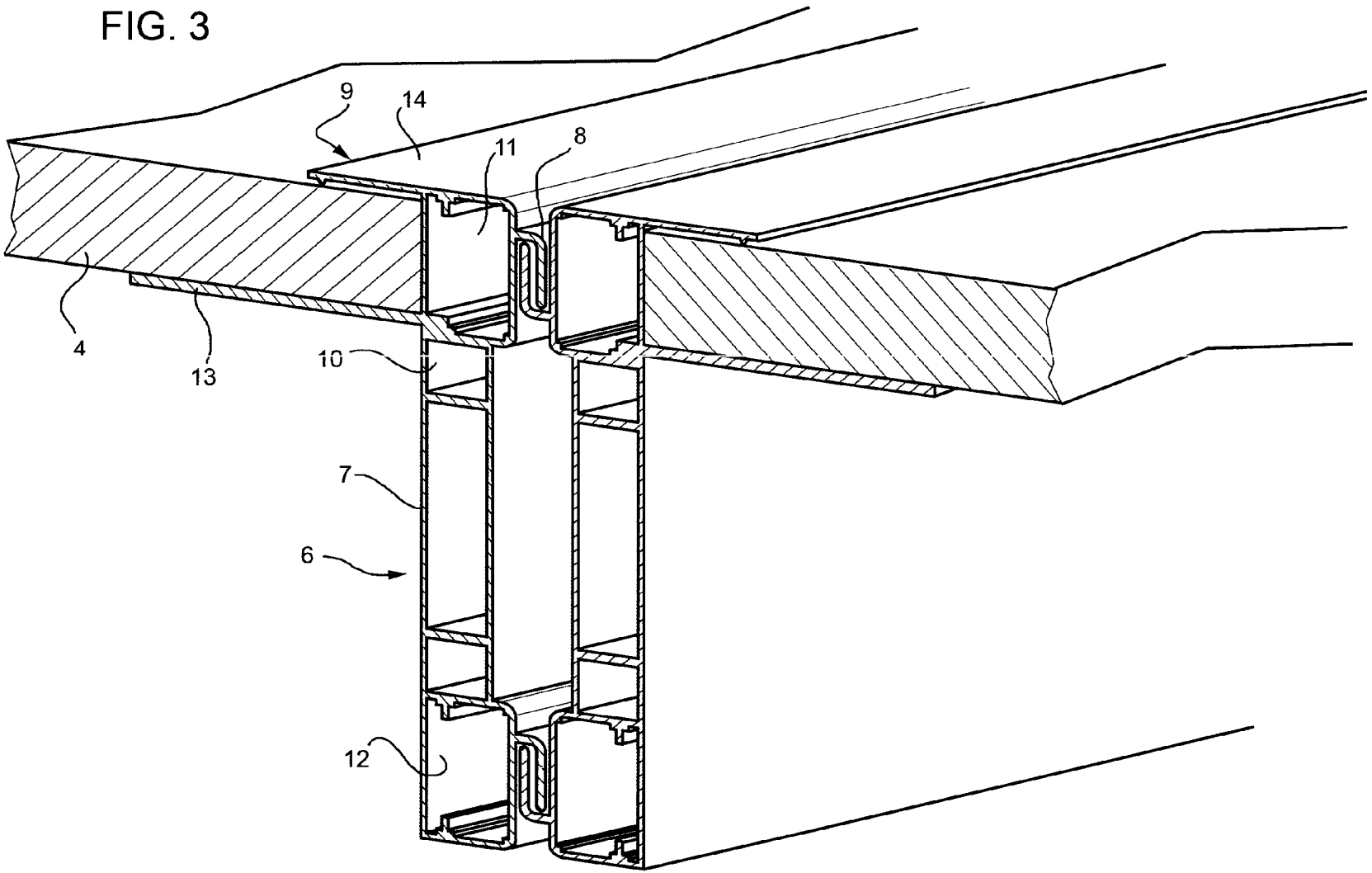
FIG. 3 shows a perspective view of a sectioned detail in FIG. 2.

FIG. 3 shows a cross-section of a profiled element (6) which includes every sides of the frame (2) with a proper personal design. Every profiled element (6) includes a main body (7), a mainly rectangular cable with a cross-section, outgoing connecting sections (8) from the main body (7), a blocking element (9) placed in the opposite position of the sections with reference to the main body (7).

In particular, the connecting sections (8) have a cross section that allows a combination that opposes the removal of two assembled Tunnels (1).

Generally, the connecting sections (8) are continuous along the same profiled element (6) in order to prevent and protect people from the falling of objects and/or rainwater because of G-force during the transition of a pedestrian between a Tunnel (1) and the other next.

In some embodiments, the connecting sections (8) have an L-shaped cross section that is composed of a wing constrained to the main body (7) and the other free wing. In other embodiments, connecting sections 8 may have differently shaped cross sections.

In the opposite side of the connecting sections (8), the profiled element (6) shows a blocking element (9) in order to fix the frame (2) to the roofing (4), for example, a plane plate made of polymeric material like translucent polycarbonate or another thermoplastic polymer.

The main body (7) has a closed cross section which also has a central part (10) or two upper and lower parts (11), (12) with a design where the above mentioned Modular Pedestrian Tunnel (1) shows the supporting opened legs (3).

The upper part (11) and the lower one (12) are in reference to the central part (10) along the direction in which the connecting sections (8) allow the connection between two Modular Tunnels (1).

Both the upper section (11) and the lower one (12) have a connecting section (8). In this way, the same sections (8) will be leant out in reference to the central part (10) allowing a simple assembly.

In some embodiments, the main body (7), connecting sections (8) and the blocking element (9) are made thanks to a die process or other manufacturing process.

Furthermore, connecting sections (8) are moved away in a cross direction with reference to a rectilinear axis of every sections allowing, in this way, the creation of a rigid tie.

The rigid tie opposes the twisting movement created by the force of weight, for instance, of the roofing (4) in order to oppose the separation of two connected Tunnels (1).

In the opposite side of the connecting section (8), the upper section (11) supports the blocking section (9) which is composed by wings, (13) and (14). These wings are embossed and spaced out at a greater or equal height of the thickness of the roofing (4) allowing, in this way, a slide combination.

In addition to this, when the Tunnel (1) is being used, the wing which is burdened with the roofing's weight (4) is spaced out from the lower section (12) at an height which allows the supporting legs (3) to be placed, rollway, when they are in the position shown in FIG. 2 with a dotted line.

Figure 4:
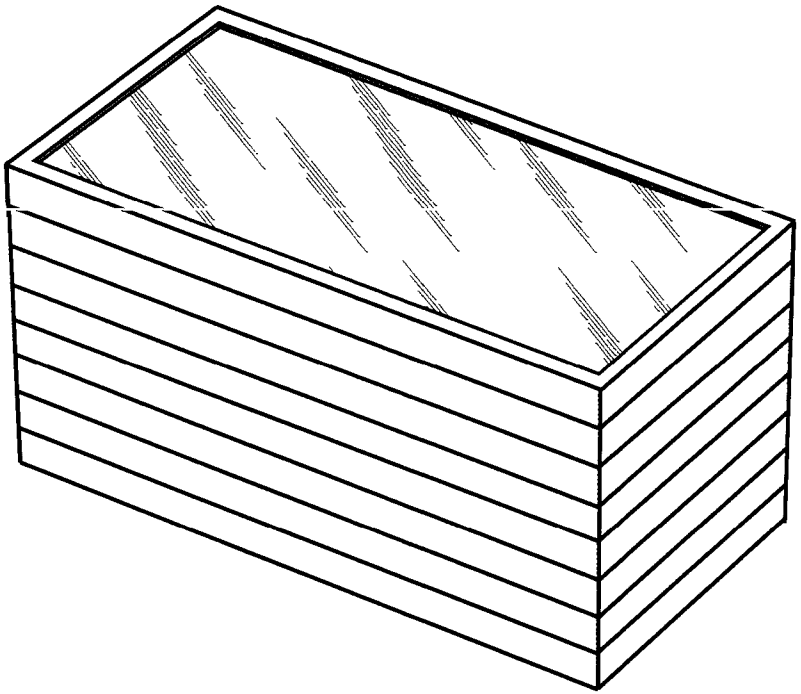
FIG. 4 shows a perspective view of some piled modules for transport and/or storing.

In this way, (FIG. 4) the Tunnels (1) can be simply piled, transported and easily placed on a flat of every vehicle because of its compactness.

As displayed in FIGS. 6-10, there is an alternative device (FIG. 5) in order to adjust and hold the angular position of the legs (3).

In particular, the alternative device includes:

A grooved element (16) fixed to the main body (7) under the roofing (4) thanks to a plane base (17) which is perpendicular to the axis of the above mentioned grooved element, a grooved sleeve (18) that can be used inside the grooved element (16) and fixed to its leg (3), a blocking device (19) in order to define the position of the grooved sleeve (18) along a B axis of the grooved element (16) and a spring (20) (only shown in a schematic way) in order to keep the grooved sleeve (18) in an operating position with the grooved element (16).

In particular, the blocking device (19) is fixed to a distance along the B axis in order to allow the sleeve (18) to be completely independent from the grooved element (16) against the action of the spring (20) thanks to the rectilinear translation.

When the Modular Pedestrian Tunnel is used, the legs (3) are in a transverse position with reference to the roofing (4), the sleeve (18) is fixed to the base (17) and it is blocked in this position thanks to the action of the spring (20).

When it is necessary to put the hidden supporting legs (3) into the frame (2) the sleeve (18) must be manually brought by the action of the spring (20) towards the blocking element (19). When the sleeve (18) is not engaged by the grooved element (16), the leg (3) rotates in a way so as to became become parallel to the main profiled body (7) connected to the base (17). In this position, the sleeve (18) can be again combined to the grooved element (16) and it can be angularly blocked.

Figure 6:
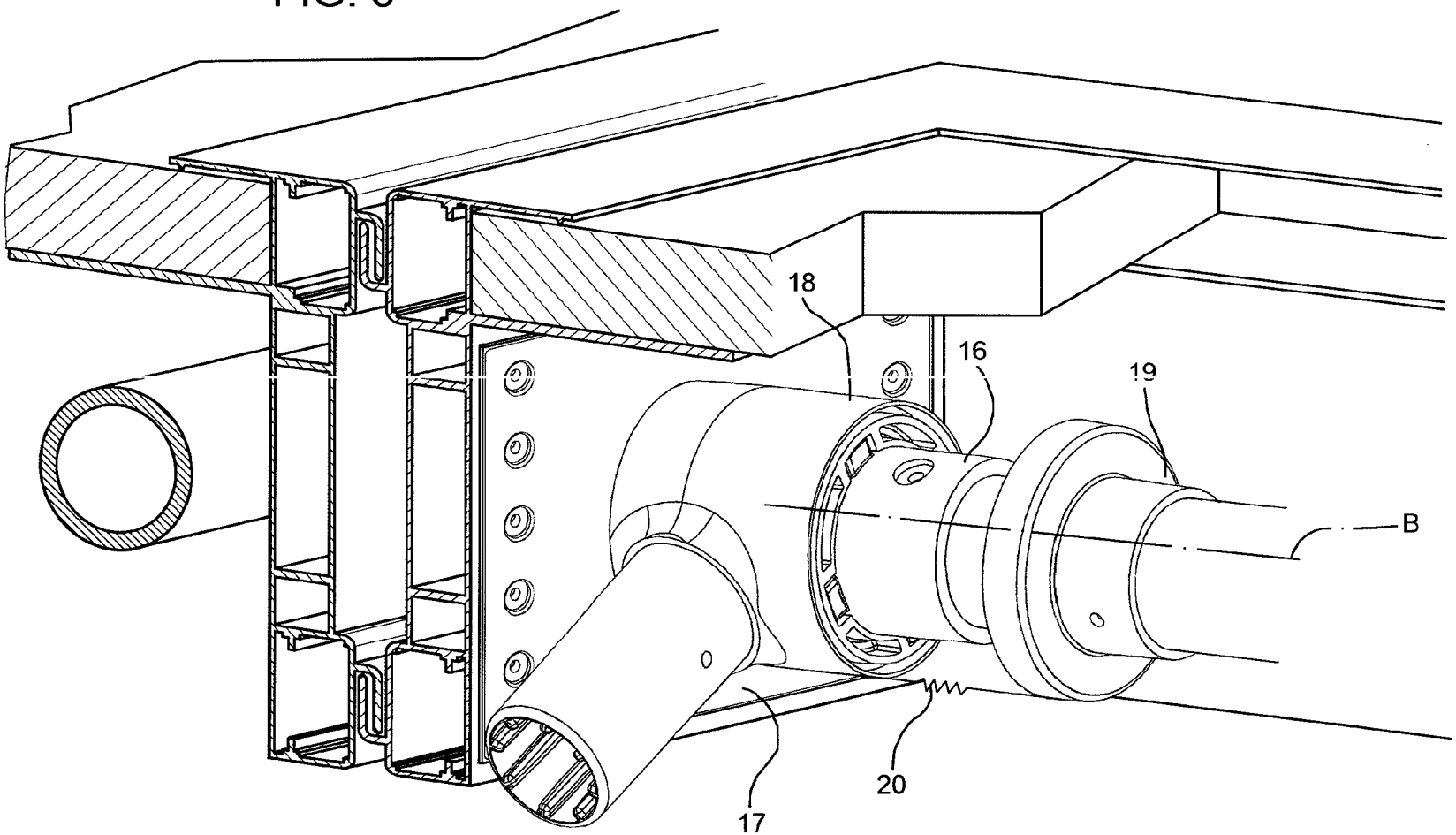
FIG. 6 shows a perspective view of a second way to produce a particular Modular Pedestrian Tunnel.
Figure 7:
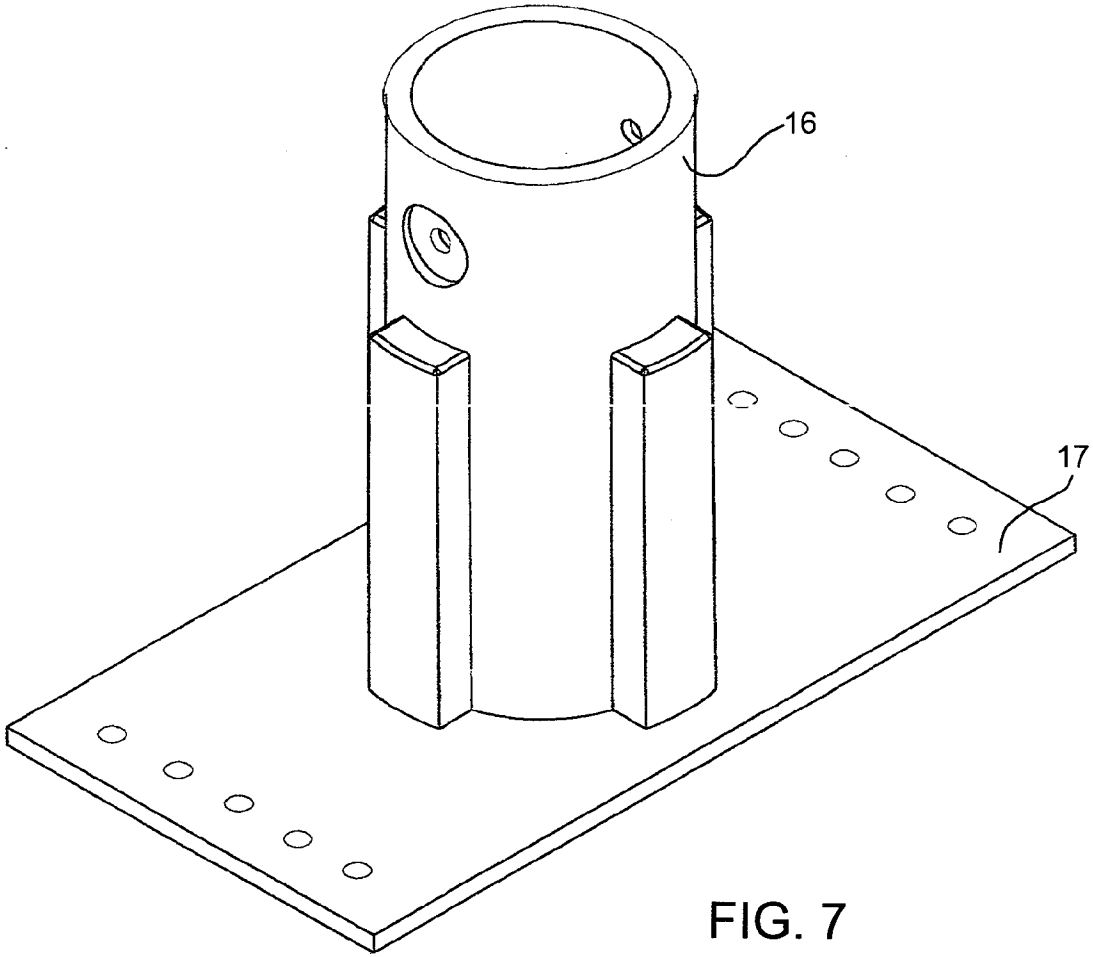
FIGS. 7 to 10 show perspective views of some details in FIG. 6. In particular.
Figure 8:
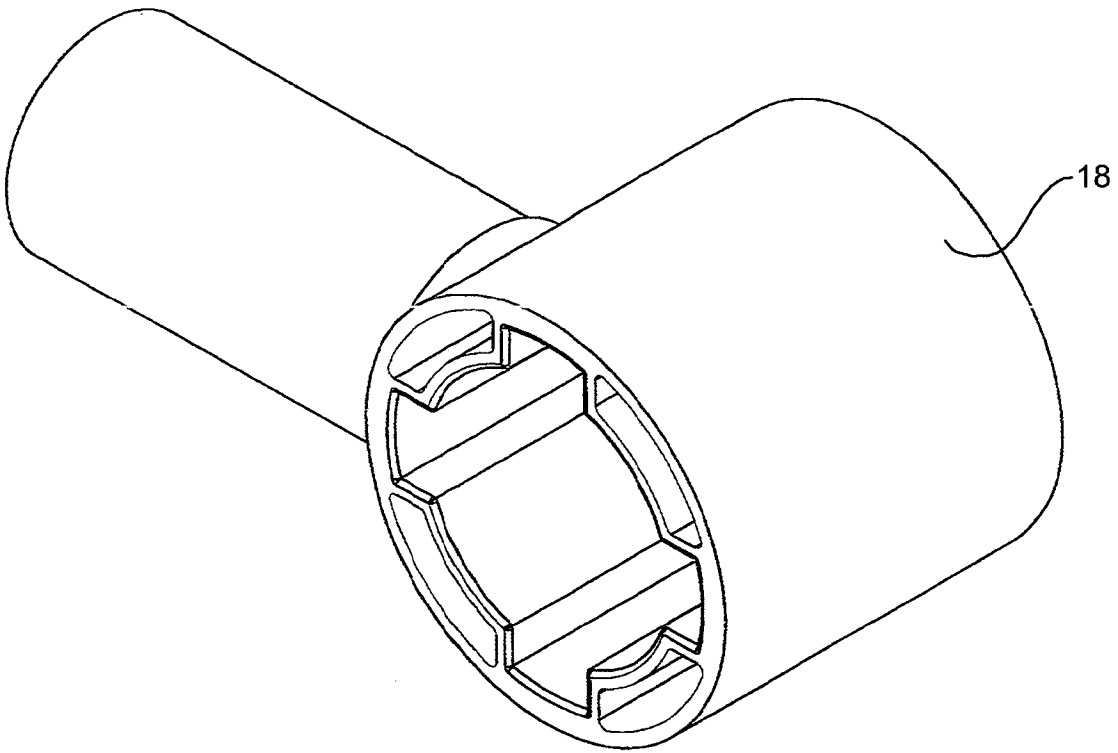
Figure 10:
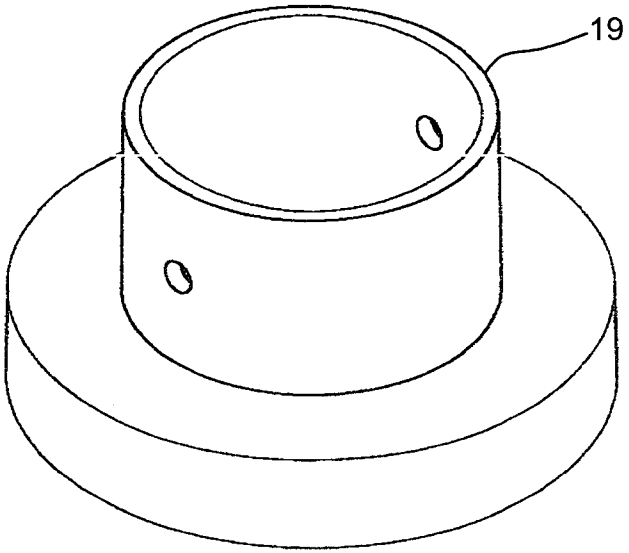
Figure 9:
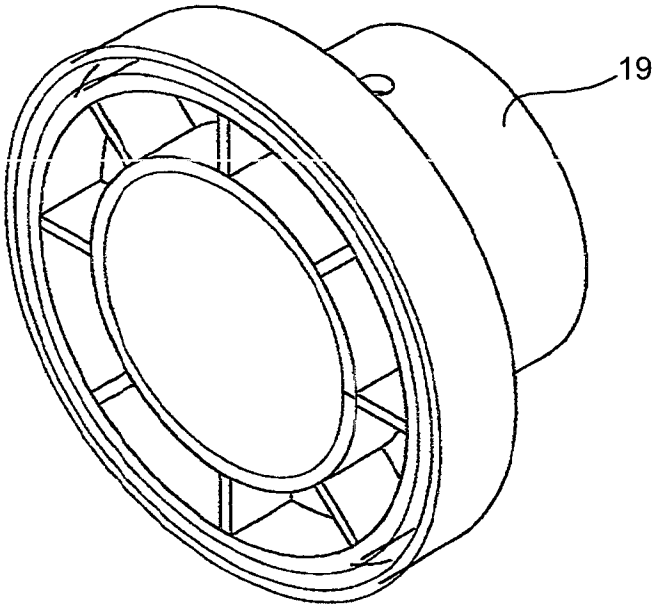

When two legs (3) are linked on opposite sides of the same section (6) and have a length such as to interfere when they are both closed, the device shown in FIG. 6 is designed to allow supporting legs to be blocked both in the operating and hidden position.

For instance, the extension of the grooved element along the B axis allows the sleeve (18) to be partially used, even though, in the hidden position, it is placed on the opposite side of the section (6) with reference to the other leg (3).

Alternatively, it is possible to put the leg (3), which is opposite to the section (6), at a further distance, with reference to another leg (3) immediately adjacent to the section (6). This, can be made both in the extraction and in the hidden position.

The aim of the Pedestrian Tunnel described herein is to protect pedestrians from accidental falling of materials, debris and/or rainwater.

The above mentioned Pedestrian Tunnel is composed by a single section that can be simply transported when its legs are in an hidden position. It can be simply assembled in wide range of combinations because of its supporting legs allowing pedestrians to move freely under the Tunnel.

In particular, when two sections (6) of two adjacent elements are linked together, it is possible to raise the two couples of legs (3) next to the connected sections. In fact, the special design of the Tunnel allows the complete resistance even if under bending and twisting stresses. In this way, it is possible to create various configurations removing superfluous legs. (3)

Finally, it is clear that even if some modifications or variations can be made on The Pedestrian Tunnel (1), here described, it will be protected as the enclosed claim state.

For example, Pedestrian Tunnels can be combined to one another to create, also, a gazebo. For instance, a gazebo may include 9 elements. In this way, a central element is completely surrounded by other elements. The connecting section (8) can withstand the load of bending and/or twisting stresses due to the weight of the central element even if, because of encumbrances, all its supporting legs (3) are closed in an hidden position.

Furthermore, the above mentioned Tunnel can be used as sunshield structure in a seaside resort or as a suitable cover in order to protect a vehicle or motorcycle when is parked.

It is to be understood that the foregoing description is intended to illustrate and not to limit the scope of the invention, which is defined by the scope of the appended claims. Other embodiments are within the scope of the following claims.

What is claimed is:

1. An apparatus comprising:

a modular pedestrian tunnel comprising:

a first pedestrian tunnel module comprising:

a rectangular frame having a perimeter defined by a first side and a second side each having a first length, and a third side and a fourth side each having a second length, a continuous plate fixed to the frame for protecting a pedestrian passing under the first pedestrian tunnel module, a first profiled element extending continuously along the first side of the frame and having a length equal to the first length, a second profiled element extending continuously along the second side of the frame and having a length equal to the first length, the second profiled element having a shape configured to interlock directly with a first profiled element of an adjacent pedestrian tunnel module, a third profiled element extending continuously along the third side of the frame and having a length equal to the second length, a fourth profiled element extending continuously along the fourth side of the frame and having a length equal to the second length, the fourth profiled element having a shape configured to interlock directly with a third profiled element of an adjacent pedestrian tunnel module, and a plurality of supporting legs hinged to the frame, wherein each of the four profiled elements is configured to withstand one or more of a bending moment and a twisting moment generated by a weight of at least the continuous plate, wherein the first profiled element comprises a structure extending along the first side of the frame and having an L-shaped cross-section having a first segment extending outward from the frame and a second segment extending from the first segment in a first direction, and wherein the second profiled element comprises a structure having a third segment extending outward from the frame and a fourth segment extending from the third segment in a second direction opposite the first direction.

2. The apparatus of claim 1, wherein each of the plurality of legs is hinged to the frame independently of each other leg in such a way that when the first pedestrian tunnel module is erected, an angular position of a first one of the legs relative to the frame can differ from an angular position of a second one of the legs relative to the frame.

3. The apparatus of claim 1, wherein the first pedestrian tunnel module is coupled to an adjacent second pedestrian tunnel module, wherein the first pedestrian tunnel module comprises:

a first leg, a second leg, a third leg, and a fourth leg, and wherein the second pedestrian tunnel module comprises:

a fifth leg, a sixth leg, a seventh leg, and a eighth leg, wherein the first leg, the second leg, the fifth leg, and the sixth leg are adjacent to connecting elements coupling the first pedestrian tunnel module and the second adjacent pedestrian tunnel module, wherein the first leg, the second leg, the fifth leg, and the sixth leg are raised, whereby the first pedestrian tunnel module and the second adjacent pedestrian tunnel module are supported only on the third leg, the fourth leg, the seventh leg, and the eighth leg.

4. The apparatus of claim 1, wherein the first profiled element comprises a structure extending along the first side of the frame and having an L-shaped cross-section having a first orientation, and wherein the second profiled element comprises a structure extending along the second side of the frame and having an L-shaped cross-section having a second orientation opposite the first orientation.

5. The apparatus of claim 1, wherein the first pedestrian tunnel module is coupled to an adjacent second pedestrian tunnel module, wherein at least one of the profiled elements of the first pedestrian tunnel module directly engages a profiled element of the second tunnel module.

6. The apparatus of claim 1, wherein the first profiled element of the first pedestrian tunnel module is configured to directly engage a profiled element of an adjacent second pedestrian tunnel module having the same structure as the second profiled element of the first pedestrian tunnel module.

7. The apparatus of claim 1, wherein the modular pedestrian tunnel further comprises a second pedestrian tunnel module adjacent to the first pedestrian tunnel module, and wherein a first profiled element of the second pedestrian tunnel module is interlocked directly with the second profiled element of the first pedestrian tunnel module.

8. An apparatus comprising:

a modular pedestrian tunnel comprising:

a first pedestrian tunnel module comprising:

a rectangular frame having a perimeter defined by a first side and a second side each having a first length, and a third side and a fourth side each having a second length, a continuous plate fixed to the frame for protecting a pedestrian passing under the first pedestrian tunnel module, a first profiled element extending continuously along the first side of the frame and having a length equal to the first length, a second profiled element extending continuously along the second side of the frame and having a length equal to the first length, the second profiled element having a shape configured to interlock directly with a first profiled element of an adjacent pedestrian tunnel module, a third profiled element extending continuously along the third side of the frame and having a length equal to the second length, a fourth profiled element extending continuously along the fourth side of the frame and having a length equal to the second length, the fourth profiled element having a shape configured to interlock directly with a third profiled element of an adjacent pedestrian tunnel module, and a plurality of supporting legs hinged to the frame, wherein each of the four profiled elements is configured to withstand one or more of a bending moment and a twisting moment generated by a weight of at least the continuous plate, wherein the first profiled element comprises a structure extending along the first side of the frame and having an L-shaped cross-section having a first segment extending outward from the frame and a second segment extending from the first segment in a first direction, wherein the second profiled element comprises a structure extending along the second side of the frame and having an L-shaped cross-section having a third segment extending outward from the frame and a fourth segment extending from the third segment in a second direction opposite the first direction, wherein the third profiled element comprises a structure extending along the third side of the frame and having an L-shaped cross-section having a fifth segment extending outward from the frame and a sixth segment extending from the fifth segment in a third direction, and wherein the fourth profiled element comprises a structure extending along the fourth side of the frame and having an L-shaped cross-section having a seventh segment extending outward from the frame and an eighth segment extending from the seventh segment in a fourth direction opposite the third direction.

9. An apparatus comprising:

a modular pedestrian tunnel comprising:

a first pedestrian tunnel module comprising:

a rectangular frame extending along a first axis and a second axis, the first and second axes perpendicular to a third axis, the rectangular frame having a continuous cover fixed to the frame for protecting a pedestrian passing under the first pedestrian tunnel module, and a plurality of supporting legs hinged to the frame, wherein the frame comprises first and second flanges securing the cover therebetween, the first and second flanges extending along a direction parallel to the first axis beyond the cover and connected to each other by a connecting portion parallel to the third axis, thereby defining a top portion of a profiled element, the profiled element extending along the third axis and having a bottom portion connected to the top portion of the profiled element via a main body, wherein a first connector is connected to the top portion of the profiled element and extends continuously along a direction parallel to the second axis, the first connector having an L-shaped cross-section that is shaped to directly interlock with a first connector of an adjacent pedestrian tunnel module, the L-shaped cross-section comprising:

a first segment that extends along the first axis away from the profiled element, and a second segment joined to the first segment and extending in a direction parallel to the third axis, and wherein a second connector is connected to the bottom portion of the profiled element and extends continuously along a direction parallel to the second axis, the second connector having an L-shaped cross-section that is shaped to directly interlock with a second connector of an adjacent pedestrian tunnel module, the L-shaped cross-section comprising:

a first segment that extends along the first axis away from the profiled element, and a second segment joined to the first segment and extending in a direction parallel to the third axis, wherein the spacing between the first and second connectors along the third axis enables the profiled element to withstand one or more of a bending moment and a twisting moment generated by a weight of the continuous cover.

10. The apparatus of claim 9, in which the profiled element is a first profiled element disposed along a first side of the rectangular frame, and further comprising:

a second profiled element disposed along an opposite side of the rectangular frame, the second profiled element comprising:

a first connector connected to the top portion of the second profiled element and having an L-shaped cross-section comprising:

a first segment that extends along the first axis away from the second profiled element, and a second segment joined to the first segment and extending in a direction parallel to the third axis and opposite to the direction of the second segment of the first connector of the first profiled element, and a second connector connected to the bottom portion of the second profiled element and having an L-shaped cross-section comprising:

a first segment that extends along the first axis away from the profiled element, and a second segment joined to the first segment and extending in a direction parallel to the third axis and opposite to the direction of the second segment of the second connector of the first profiled element.

11. The apparatus of claim 9, in which the modular pedestrian tunnel comprises a second pedestrian tunnel module, wherein the second pedestrian tunnel module is joined to the first pedestrian tunnel module through (1) a direct interlocking connection between the first connector of the first pedestrian tunnel module and a first connector of the second pedestrian tunnel module and (2) a direct interlocking connection between the second connector of the first pedestrian tunnel module and a second connector of the second pedestrian tunnel module.

* * * * *